US011143003B2

(12) United States Patent
Novelen et al.

(10) Patent No.: US 11,143,003 B2
(45) Date of Patent: Oct. 12, 2021

(54) METHODS TO DEHYDRATE GRAVEL PACK AND TO TEMPORARILY INCREASE A FLOW RATE OF FLUID FLOWING FROM A WELLBORE INTO A CONVEYANCE

(71) Applicant: Halliburton Energy Services, Inc., Houston, TX (US)

(72) Inventors: Ryan Michael Novelen, Grand Prairie, TX (US); Edmund Christopher Williamson, Little Elm, TX (US); Stephen Michael Greci, Little Elm, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 71 days.

(21) Appl. No.: 16/581,003

(22) Filed: Sep. 24, 2019

(65) Prior Publication Data

US 2021/0087908 A1 Mar. 25, 2021

(51) Int. Cl.

| | |
|---|---|
| ***E21B 43/04*** | (2006.01) |
| ***E21B 34/06*** | (2006.01) |
| ***E21B 43/08*** | (2006.01) |

(52) U.S. Cl.

CPC ..... *E21B 43/04* (2013.01); *E21B 34/063* (2013.01); *E21B 43/08* (2013.01)

(58) Field of Classification Search

CPC ..... E21B 43/04; E21B 43/08; E21B 34/063
See application file for complete search history.

(56) References Cited

U.S. PATENT DOCUMENTS

| | | | | |
|---|---|---|---|---|
| 6,976,542 | B2 | 12/2005 | Henriksen et al. | |
| 7,409,999 | B2 | 8/2008 | Henriksen et al. | |
| 7,708,068 | B2 * | 5/2010 | Hailey, Jr. | E21B 34/08 166/278 |
| 7,828,067 | B2 | 11/2010 | Scott et al. | |
| 8,291,982 | B2 | 10/2012 | Murray et al. | |
| 2009/0008092 | A1 | 1/2009 | Haeberle et al. | |
| 2011/0030969 | A1 * | 2/2011 | Richards | E21B 34/14 166/373 |
| 2015/0308238 | A1 * | 10/2015 | Langlais | E21B 43/04 166/278 |
| 2016/0215595 | A1 | 7/2016 | Lopez et al. | |

FOREIGN PATENT DOCUMENTS

| | | |
|---|---|---|
| WO | 2010120419 | 10/2010 |

OTHER PUBLICATIONS

International Search Report and Written Opinion for corresponding PCT International Application No. PCT/US2019/052941, dated Jun. 19, 2020.

* cited by examiner

*Primary Examiner* — Michael R Wills, III
(74) *Attorney, Agent, or Firm* — McGuireWoods LLP

(57) ABSTRACT

Methods to dehydrate a gravel pack and to temporarily increase a flow rate of fluid flowing from a wellbore into a conveyance are disclosed. A method to dehydrate gravel pack includes deploying a valve at a location proximate a gravel pack. The valve includes a rupture disk that ruptures in response to a threshold amount of pressure, and reactive fluid that actuates the valve to a closed position. The method also includes providing a fluid flow path from the gravel pack to the conveyance. The method further includes closing the valve after providing the fluid flow path from the gravel pack to the conveyance for a threshold period of time.

20 Claims, 8 Drawing Sheets

METHODS TO DEHYDRATE GRAVEL PACK AND TO TEMPORARILY INCREASE A FLOW RATE OF FLUID FLOWING FROM A WELLBORE INTO A CONVEYANCE

BACKGROUND

The present disclosure relates generally to methods to dehydrate gravel pack and to temporarily increase a flow rate of fluid flowing from a wellbore into a conveyance.

Gravel packing operations are often performed during completion operations to prevent production of formation sand or other undesirable particles. A gravel pack completion sometimes includes a sand screen that is deployed on a conveyance and at a position proximate to the desired production interval. A fluid slurry including a liquid carrier and a particulate material known as gravel is then pumped down the conveyance and into the well annulus formed between the sand control screen and a perforated well casing or open-hole production zone. Improper dehydration of gravel sometimes results in formation of loose gravel pack which causes the sand screen to become exposed due to settling from the loose-packed area. The exposed sand screen is susceptible to premature failure.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

Figure 1A:
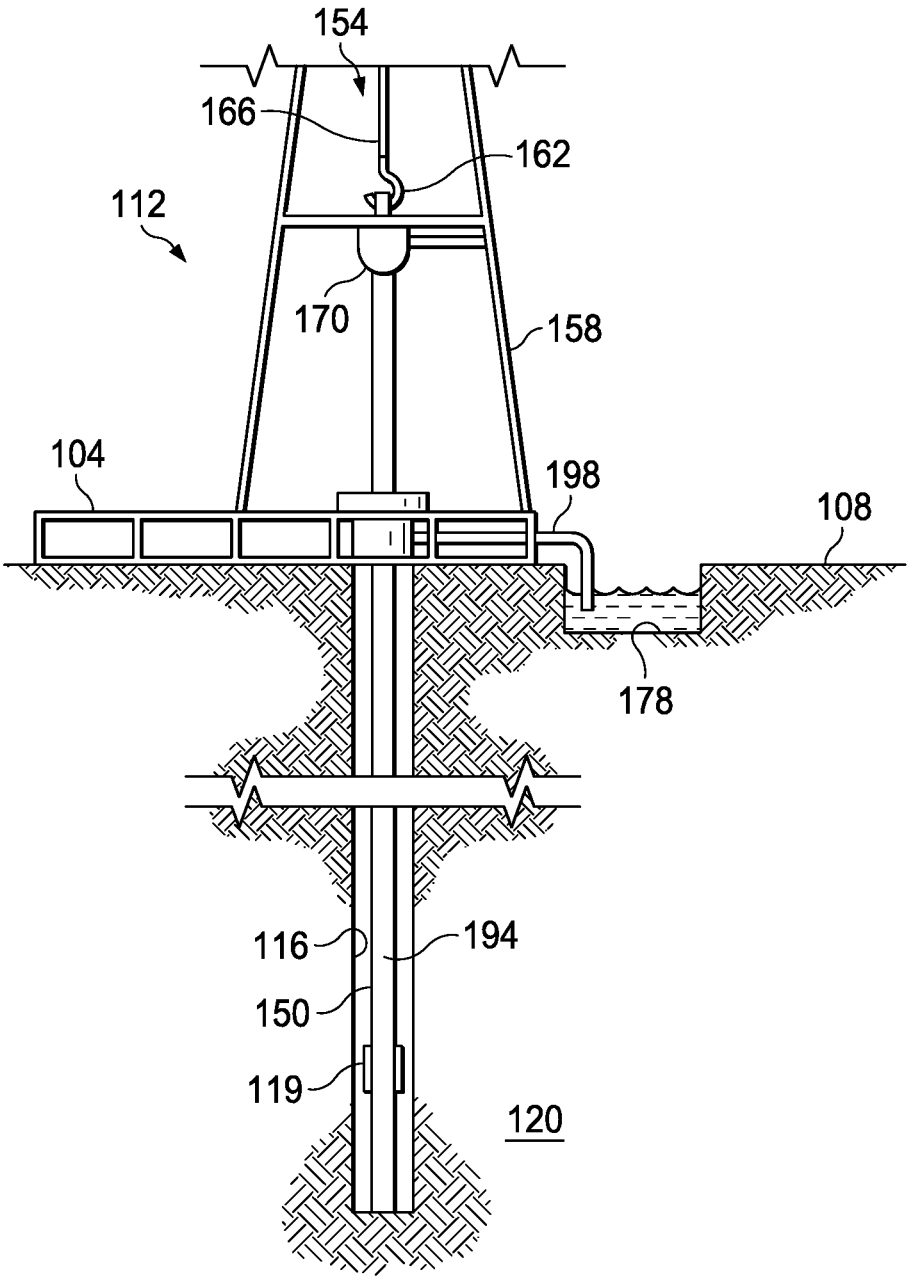
FIG. 1A illustrates a schematic view of an on-shore well having a valve deployed in a wellbore during well completion to dehydrate gravel pack and to temporarily increase a flow rate of fluid flowing from the wellbore into a conveyance.

The illustrated figures are only exemplary and are not intended to assert or imply any limitation with regard to the environment, architecture, design, or process in which different embodiments may be implemented.

DETAILED DESCRIPTION OF ILLUSTRATIVE EMBODIMENTS

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to methods to dehydrate gravel pack and methods to temporarily increase a flow rate of fluid flowing from a wellbore into a conveyance. The method includes deploying a valve device (valve) to a location proximate one or more fluid flow paths that fluidly connect a gravel pack to a conveyance, where the valve initially provides a new fluid flow path from the gravel pack to the conveyance. As referred to herein, a conveyance may be a drill string, drill pipe, coiled tubing, production tubing, downhole tractor or another type of conveyance deployable in a wellbore. Further, as referred to herein, the valve is any device or component configured to initially provide a fluid flow path and is further configured to close the fluid flow path after a threshold period of time (e.g., 5 minutes, 10 minutes, 1 hour, or another desired or predetermined amount of time).

The valve includes a body (e.g., a tubular body) containing swellable elastomer. As referred to herein, a swellable elastomer is any elastomer with elastic properties. In some embodiments, the swellable elastomer is rubber or a rubber-like substance. In some embodiments, the swellable elastomer swells by at least 10% by volume when it contacts a liquid such as water or hydrocarbon fluid. In one or more of such embodiments, the swellable elastomer's swelling is directed through the use of obstructions that prevent swelling in some directions but permit swelling in other directions. In some embodiments, the swellable elastomer swells in response to a reactive fluid. In one or more of such embodiments, the reactive fluid is contained in the body of a reactive fluid chamber. In some examples, the reactive fluid is added to the body of the reactive fluid chamber prior to the valve being deployed down the wellbore. In some embodiments, the reactive fluid contacts the swellable elastomer to cause the swellable elastomer to swell as the valve travels down the wellbore.

In some embodiments, the valve includes a piston component (piston). In one or more of such embodiments, the swellable elastomer swells and contacts the piston to move the piston from a first position (e.g., an open state) to a second position (e.g., a closed state). In the second position, the piston can open, close, or restrict one or more flow paths through the valve. In some embodiments, the valve initially provides a fluid flow path to allow well fluid to travel from an inlet opening of the valve through the body of the valve to an outlet opening of the valve.

In some embodiments, the valve has a floating piston that is positioned within the body and adjacent to the reactive fluid. In one or more of such embodiments, the floating piston is movable within the body of the valve toward the reactive fluid. In one or more of such embodiments, the floating piston aids in increasing the pressure in the reactive fluid or increasing the speed or amount of reactive fluid that contacts the swellable elastomer.

In some embodiments, the valve also includes one or more rupture discs that are positioned between the reactive fluid and the swellable elastomer. In one or more of such embodiments, the one or more rupture discs remain intact and prevent the reactive fluid from contacting the swellable elastomer until a predetermined condition (e.g., a predetermined time or a threshold amount of pressure) has been met. Once the predetermined condition has been met, the one or more rupture discs rupture, thereby allowing the reactive fluid to contact the swellable elastomer. For example, the rupture discs rupture once the reactive fluid has reached a certain pressure. Additionally or alternatively, the rupture discs rupture in response to hydrostatic pressure in the wellbore, pressure in the wellbore above bottom-hole pressure, or increased temperature in the wellbore.

In some embodiments, the valve also includes a retainer disc (e.g., a mesh disk) that is mounted in the body of the valve to restrict the swelling of the swellable elastomer. In one or more of such embodiments, the retainer disc prevents the swellable elastomer from swelling in a direction away from the piston and provides a reaction to axial swell forces. In one or more of such embodiments, the retainer disc includes holes or mesh that allow the reactive fluid to flow through the retainer disc and contact the swellable elastomer.

In some embodiments, the piston includes a snap ring that holds the piston in place and prevents axial movement. In one or more of such embodiments, the snap ring is coupled with the piston and used to latch into a groove in the body of the valve. In one or more of such embodiments, the snap ring holds the piston in place before or after movement. For example, the snap ring holds the piston in place after the piston has moved from the first position to the second position. Additionally or alternatively, the piston includes one or more O-rings that help hold the piston in position. For example, the O-rings are configured to prevent the piston from moving before the swellable elastomer has swollen.

After a threshold period of time, the fluid flow path through the valve is substantially reduced. As referred to herein, fluid flow is substantially reduced if the flow rate is at or below a threshold rate (e.g., one liter per hour, one milliliter per hour, zero, or another rate). In some embodiments, the valve is open for a predetermined period of time (e.g., 5 minutes, 10 minutes, 1 hour, or another predetermined period of time), and is closed after the threshold period of time. In some embodiments, the valve is closed after a threshold amount of liquid (e.g., 1 gallon, 10 gallons, or another amount of liquid) flows through the fluid flow path. In some embodiments, fluid passes through a filter (e.g., a screen) before flowing into the valve. In one or more of such embodiments, the filter forms a housing around the valve. In one or more of such embodiments, the filter is configured to prevent particles having dimensions greater than a threshold dimension from flowing into the valve. In some embodiments, the conveyance has one or more perforations through the conveyance, and the valve is deployed near the perforations to provide an additional fluid flow path into the conveyance. In one or more of such embodiments, the valve is coupled to the conveyance at a location near the perforations before the conveyance is deployed downhole. In some embodiments, the valve is coupled to the conveyance at a location near one or more flow restrictors. In one or more of such embodiments, after deployment of the conveyance, the fluid flow path through the valve allows fluids to bypass the flow restrictors and flow into the conveyance through the valve. The valve is subsequently closed after a threshold period of time, thereby allowing the flow restrictors to regulate fluid flow after the threshold period of time.

In some embodiments, multiple valves are coupled to the conveyance to provide additional fluid flow paths into the conveyance. In one or more of such embodiments, the valves close at different times, thereby varying the flow rate through the valves over time. Additional descriptions of methods to dehydrate gravel are provided in the paragraphs below. Although the foregoing paragraph describes flowing fluid from the wellbore through the valve and into the conveyance, in some embodiments, the valve is configured to provide a fluid flow path in an opposite direction and the operations described herein are performed to temporarily flow fluid out of the conveyance.

In addition to dehydrating gravel pack, the operations described herein are also performed to temporarily increase fluid flow rate from the wellbore into a conveyance having one or more valves described herein that are coupled to the conveyance. Additional descriptions and illustrations of the foregoing processes are provided in the paragraphs below.

Now turning to the figures, FIG. 1A illustrates a schematic view of an on-shore well 112 having a valve 119 deployed in a wellbore 116 during well completion to dehydrate gravel pack and to temporarily increase a flow rate of fluid flowing from wellbore 116 into a conveyance 150.

Figure 1B:
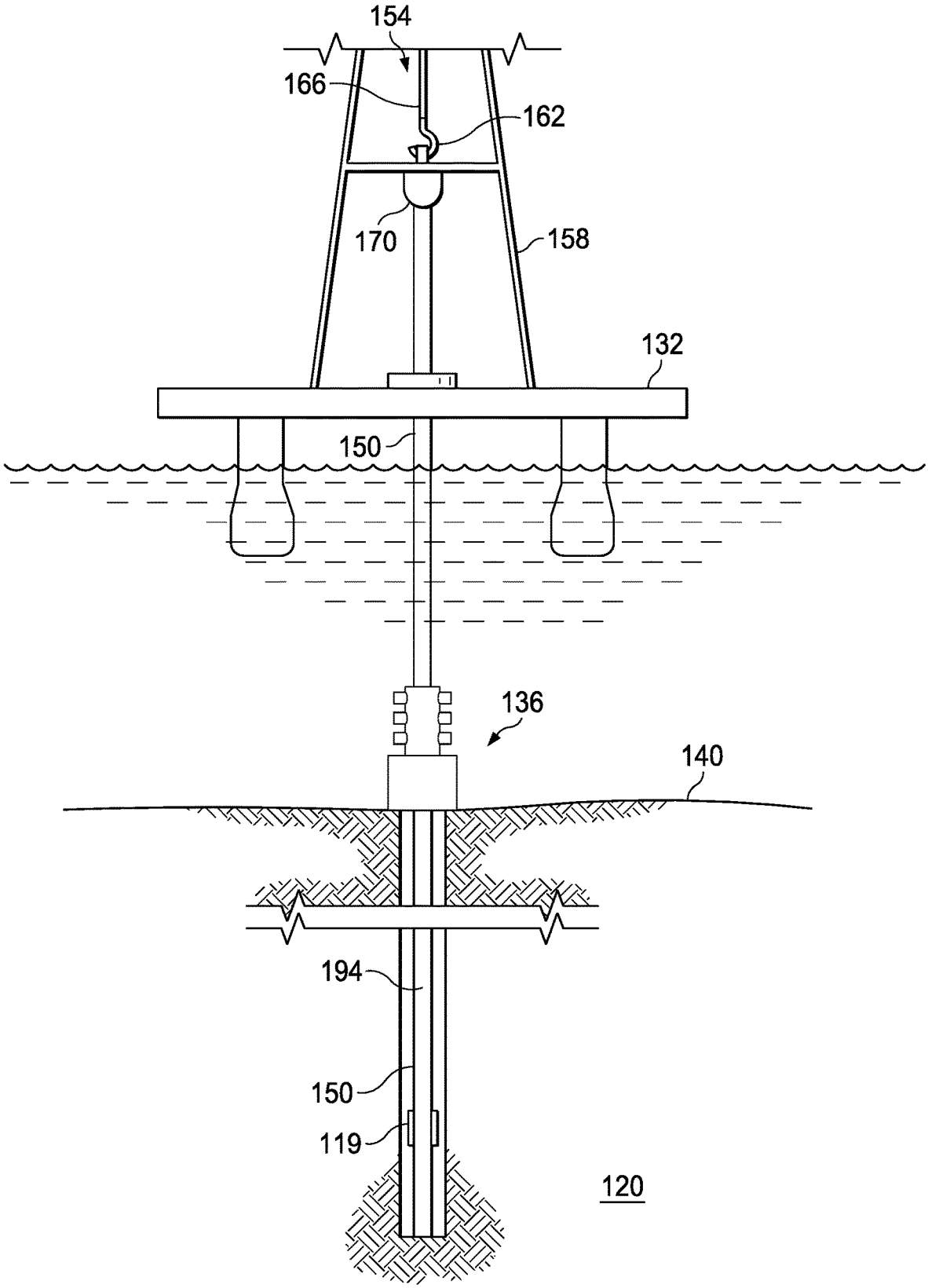
FIG. 1B illustrates a schematic view of an offshore platform having a valve deployed in a wellbore during well completion to dehydrate gravel pack and to temporarily increase a flow rate of fluid flowing from the wellbore into a conveyance.

Well 112 includes wellbore 116 that extends from surface 108 of well 112 to a subterranean substrate or formation 120. Well 112 and rig 104 are illustrated onshore in FIG. 1A. Alternatively, FIG. 1B illustrates a schematic view of an offshore platform 132 having a valve 119 according to an illustrative embodiment. Valve 119 in FIG. 1B is deployed in a sub-sea well 136 accessed by the offshore platform 132. In some embodiments, offshore platform 132 is a floating platform. In some embodiments, offshore platform 132 is anchored to a seabed 140.

In the embodiments illustrated in FIGS. 1A and 1B, wellbore 116 has been formed by a drilling process in which dirt, rock and other subterranean material is removed to create wellbore 116. In some embodiments, a portion of wellbore 116 is cased with a casing (not illustrated). In other embodiments, wellbore 116 is maintained in an open-hole configuration without casing. The embodiments described herein are applicable to either cased or open-hole configurations of wellbore 116, or a combination of cased and open-hole configurations in a particular wellbore.

After drilling of wellbore 116 is complete and the associated drill bit and drill string are "tripped" from wellbore 116, a conveyance 150, which in some embodiments eventually function as a production string, is lowered into wellbore 116. In some embodiments, conveyance 150 includes an interior 194 disposed longitudinally in conveyance 150 that provides fluid communication between the surface 108 of well 112 of FIG. 1A and a downhole location in the formation 120.

In the embodiments of FIGS. 1A and 1B, conveyance 150 is lowered by a lift assembly 154 associated with a derrick 158 positioned on or adjacent to the rig 104 as shown in FIG. 1A or offshore platform 132 as shown in FIG. 1B. The lift assembly 154 includes a hook 162, a cable 166, a traveling block (not shown), and a hoist (not shown) that cooperatively work together to lift or lower a swivel 170 that is coupled to an upper end of conveyance 150. In some embodiments, conveyance 150 is raised or lowered as needed to add additional sections of tubing to conveyance 150 to position valve 119 at the downhole location in wellbore 116.

In some embodiments, valve 119 includes a rupture disc and reactive fluid. Further, valve 119 is initially in an open position when deployed in wellbore 116, and maintains the open position for a threshold period of time, after which valve 119 is closed. Additional embodiments and components of valve 119 are described herein. Valve 119 initially provides a fluid flow path for fluid, such as extraneous fluid pumped downhole during a gravel pack operation, to flow from wellbore 116, through valve 119, and into interior 194 of conveyance 150, where the fluid flows uphole, through an outlet conduit 198, and into a container 178 of FIG. 1A. Valve 119 subsequently closes after a period of time, thereby preventing additional fluid from flowing through valve 119 into interior 194 of conveyance 150.

Although FIGS. 1A and 1B illustrate completion environments, valve 119 is deployable in various production environments or drilling environments where valve 119 is deployable to temporarily increase fluid flow from wellbore 116 to interior 194. In some embodiments, a surface-based fluid such as slurry, fracture fluid, or other type of fluid is pumped from a fluid source (not shown), through conveyance 150 into wellbore 116 during a well operation. In one or more of such embodiments, the surface-based fluid is filtered before the surface-based fluid flows through valve 119 and back into conveyance 150, where the surface-based fluid is transported uphole towards surface 108. Further, although FIGS. 1A and 1B illustrate a single valve 119, multiple valves 119 are deployable in well 112. In some embodiments, multiple valves 119 are simultaneously deployed downhole to further dehydrate gravel pack or to further increase the rate at which fluid flows from wellbore 116 into interior 194. Further, although FIGS. 1A and 1B illustrate open-hole configurations, valve 119 described herein is also deployable in cased-hole configurations. In some embodiments, valve 119 is a component of a dehydration assembly that is coupled to conveyance 150. In that regard, embodiments of dehydration assemblies are provided in the paragraphs below and are illustrated in at least FIGS. 2, 3A, 3B, and 4.

Figure 2:
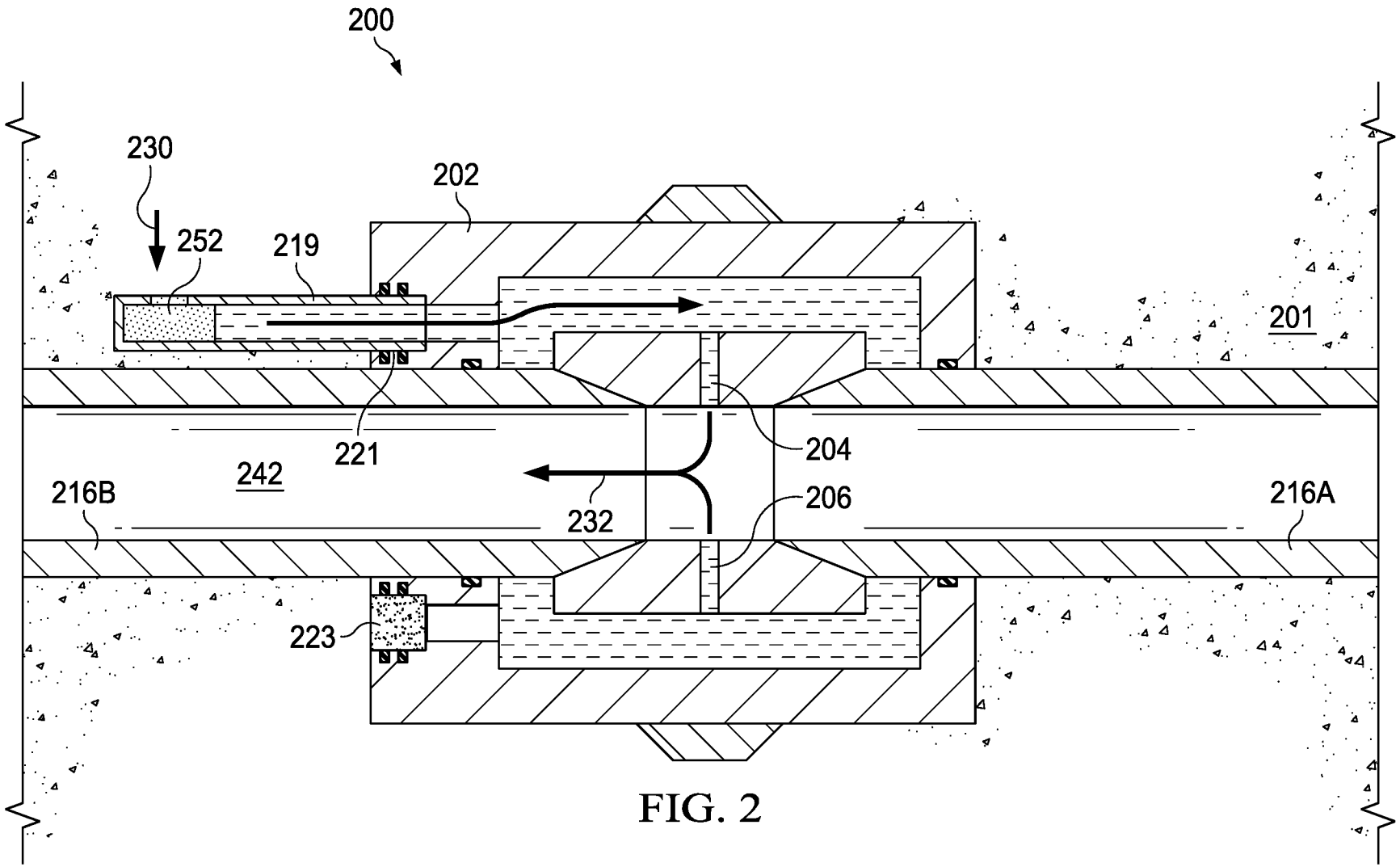
FIG. 2 illustrates a cross-sectional view of a dehydration assembly deployed in a wellbore with a gravel pack, and configured to dehydrate the gravel pack and to temporarily increase a flow rate of fluid flowing from the wellbore into a conveyance.

FIG. 2 illustrates a cross-sectional view of a dehydration assembly 200 deployed in a wellbore with a gravel pack 201, and configured to dehydrate gravel pack 201 and to temporarily increase a flow rate of fluid flowing from the wellbore into a conveyance, such as conveyance 150 of FIGS. 1A and 1B. As shown in FIG. 2, dehydration assembly 200 has a housing 202 that is coupled to a joint area between a first conveyance section 216A and a second conveyance section 216B. In the illustrated embodiment, the first and second conveyance sections 216A and 216B form portions of conveyance 150 of FIGS. 1A and 1B. In some embodiments, dehydration assembly 200 is installed around the joint area before conveyance 150 is deployed downhole. In one or more of such embodiments, dehydration assembly 200 is welded around the joint area. In one or more of such embodiments, dehydration assembly 200 slides across first conveyance section 216A, and is welded or is coupled to the joint area through one or more mechanical, physical, or chemical processes to securely couple dehydration assembly 200 to the joint area. In the illustrated embodiment of FIG. 2, dehydration assembly 200 has two insertion ports 221 and 223 along opposing sides. As referred to herein, an insertion port in a port configured to receive a valve described herein, such as valve 219, and to provide a fluid flow path from the valve to a conveyance, such as second conveyance section 216B. Valve 219 is coupled to insertion port 221 to provide a fluid flow path in a direction indicated by arrow 230 from gravel pack 201 into an opening of valve 219, through valve 219 and dehydration assembly 200, and into an interior 242 of second conveyance section 216B, where the fluid flows uphole in a direction illustrated by arrow 232. Further, a filter 252 is coupled to valve 219 to prevent particles greater than a threshold dimension from flowing into valve 219. In some embodiments, filter 252 is a screen. In one or more of such embodiments, the screen is wrapped around valve 219 or forms a housing around valve 219.

As shown in FIG. 2, valve 219 is inserted into insertion port 221, whereas insertion port 223 is not coupled to a valve. In some embodiments, insertion port 223 is coupled to a second valve (not shown) to provide an additional fluid flow path from gravel pack 201 through the valves and into second conveyance section 216B. In some embodiments, valve 219 and the second valve are configured to close at different times to substantially reduce fluid flow through the valves at different times, thereby varying the amount of fluid flow from gravel pack 201 over time. In one or more of such embodiments, valve 219 and the second valve are configured to close after different threshold amounts of fluid flow through the respective valves. Although FIG. 2 illustrates having two insertion ports, in some embodiments, dehydration assembly 200 contains additional insertion ports that are coupled to valves to increase and modulate fluid flow through dehydration assembly 200. Further, in some embodiments, valve 219 is directly coupled to dehydration assembly 200 without any insertion port.

Dehydration assembly 200 also includes a first fluid port 204 and a second fluid port 206 that fluidly connect dehydration assembly 200 to the joint area of the conveyance. In one or more of such embodiments, devices (not shown) are placed near the first and second fluid ports 204 and 206 and are configured to cover first and second fluid ports 204 and 206 to restrict fluid flow into the joint area. In one or more of such embodiments, the devices are configured to actuate to cover the first and second fluid ports 204 and 206 at a predetermined time, or after a predetermined amount of fluid flow into the joint area. In one or more of such embodiments, the devices initially cover first and second fluid ports 204 and 206, and are opened after a predetermined or operator configurable amount of time, such as during or after gravel packing operations. Further, although FIG. 2 illustrates deployment of dehydration assembly 200 around gravel pack 201, dehydration assembly 200 of FIG. 2 is also deployable in other downhole environments to temporarily increase fluid flow into a conveyance deployed in the respective downhole environments. Although the foregoing paragraphs describe providing fluid flow into second conveyance section 216B, in some embodiments, valve 219 provides a fluid flow path out of second conveyance section 216B, and dehydration assembly 200 is deployed to temporarily provide fluid flow out of second conveyance section 216B.

Figure 3A:
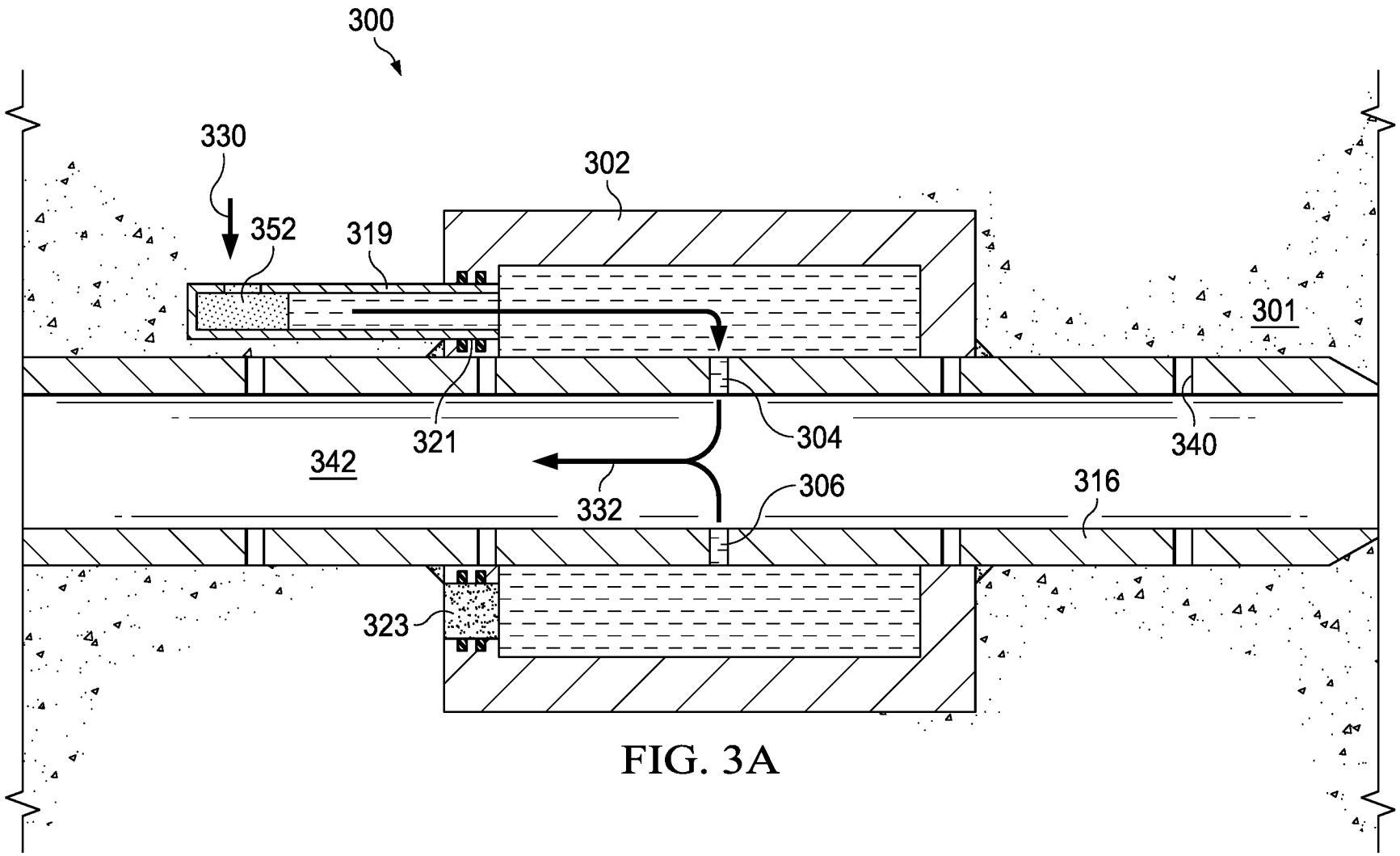
FIG. 3A illustrates a cross-sectional view of another dehydration assembly deployed in a wellbore with a gravel pack, and configured to dehydrate the gravel pack and to temporarily increase a flow rate of fluid flowing from the wellbore into a conveyance.

FIG. 3A illustrates a cross-sectional view of another dehydration assembly 300 deployed in a wellbore with a gravel pack 301, and configured to dehydrate gravel pack 301 and to temporarily increase a flow rate of fluid flowing from the wellbore into a conveyance 316. In the illustrated embodiment of FIG. 3A, multiple perforations 340 are formed through conveyance 316, which provide fluid flow paths into conveyance 316. Further, a housing 302 of dehydration assembly 300 is coupled to a section of conveyance 316 that is near perforations 340. In the illustrated embodiment of FIG. 3A, dehydration assembly 300 has two insertion ports 321 and 323 along opposing sides. Valve 319 is inserted into insertion port 321 to provide an additional fluid flow path in a direction indicated by arrow 330 from gravel pack 301 into an opening of valve 319, through valve 319 and dehydration assembly 300, and into an interior 342 of conveyance 316, where the fluid flows uphole in a direction illustrated by arrow 332, thereby increasing the fluid flow rate of the fluid into conveyance 316. In some embodiments, valve 319 closes after a threshold amount of fluid has passed through valve 319, while perforations 340 remain open to provide secondary fluid flow paths into conveyance 316. Further, a filter 352, similar to filter 252 of FIG. 2, is coupled to valve 319 to prevent particles greater than a threshold dimension from flowing into valve 319.

As shown in FIG. 3A, valve 319 is inserted into insertion port 321, whereas insertion port 323 is not coupled to a valve. In some embodiments, insertion port 323 is coupled to a second valve (not shown) to provide an additional fluid flow path from gravel pack 301 through the valves and into conveyance 316. Additional configurations of multiple valves utilized to dehydrate gravel pack and to increase fluid flow into a conveyance are described herein.

Dehydration assembly 300 also includes a first fluid port 304 and a second fluid port 306 that fluidly connect dehydration assembly 300 to interior 342 of conveyance 316. In some embodiments, first fluid port 304 and second fluid port 306 are initially covered. In other embodiments, first fluid port 304 and second fluid port 306 are initially open and are subsequently covered to modulate fluid flow into conveyance 316. Additional descriptions of configurations of fluid ports to modulate fluid flow into a conveyance are described herein.

Figure 3B:
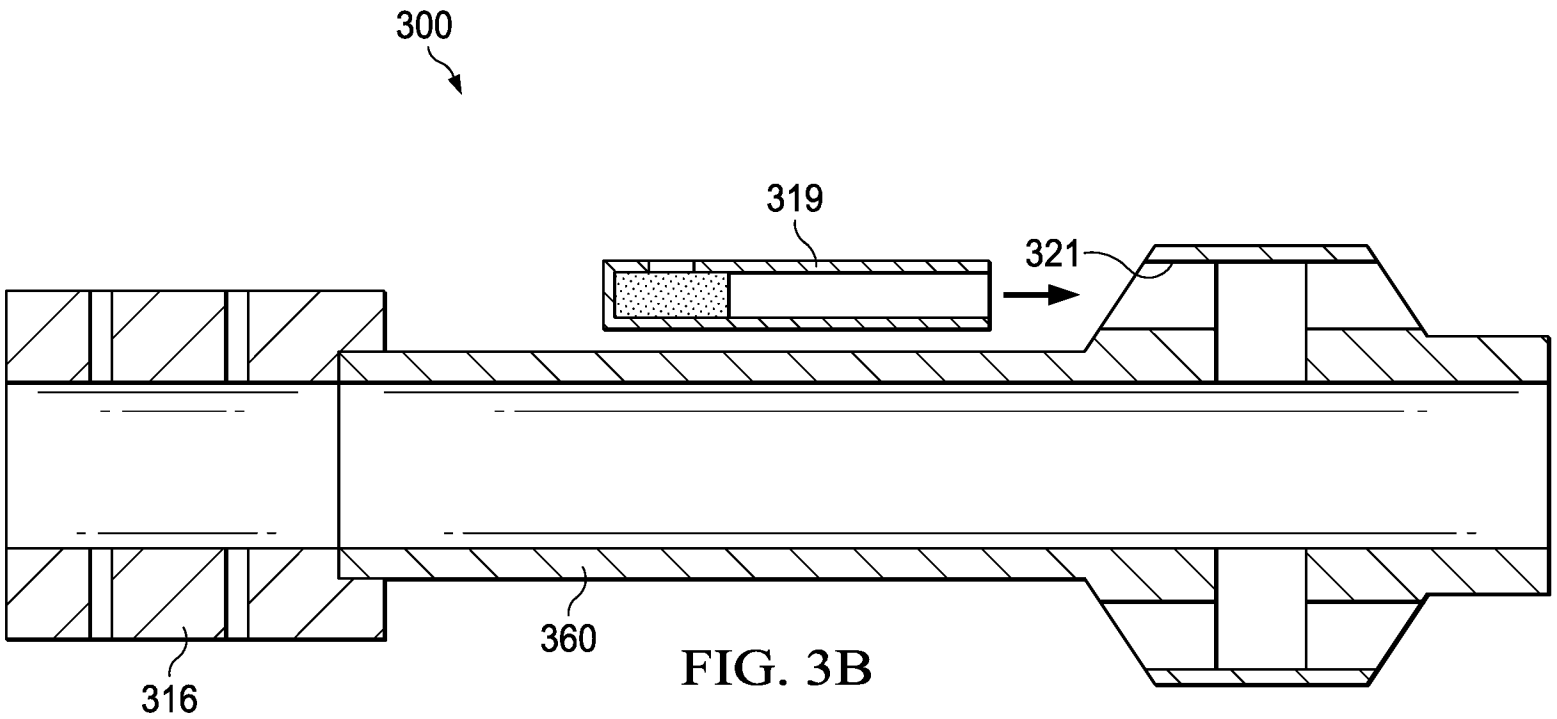
FIG. 3B illustrates a cross-sectional view of another embodiment of the dehydration assembly of FIG. 3A.

FIG. 3B illustrates a cross-sectional view of another embodiment of the dehydration assembly 300 of FIG. 3A. In the illustrated embodiment of FIG. 3B, dehydration assembly 300 is a component of or is coupled to a machined mandrel 360. Machined mandrel 360 is coupled to any location along the length of conveyance 316. Valve 319 is inserted into insertion port 321 and provides a fluid flow path through valve 319 and into conveyance 316. In some embodiments, additional valves (not shown) are inserted into machined mandrel 360 to provide additional fluid flow paths into conveyance 316. The fluid flow rate into conveyance 316 temporarily increases while valve 319 is open to facilitate a gravel dehydration operation, or other operations where temporary flow or a temporary increase in fluid flow is desired, and revert to a slower flow rate after completion of the gravel dehydration operation. Although FIGS. 3A and 3B illustrate deployment of dehydration assembly 300 around gravel pack 301, dehydration assembly 300 of FIGS. 3A and 3B is also deployable in other downhole environments to temporarily increase fluid flow into or out of a conveyance deployed in the respective downhole environments. In one or more of such embodiments, valve 319 provides a fluid flow path out of conveyance 316, and dehydration assembly 300 is deployed to temporarily provide fluid flow out of conveyance 316.

Figure 4:
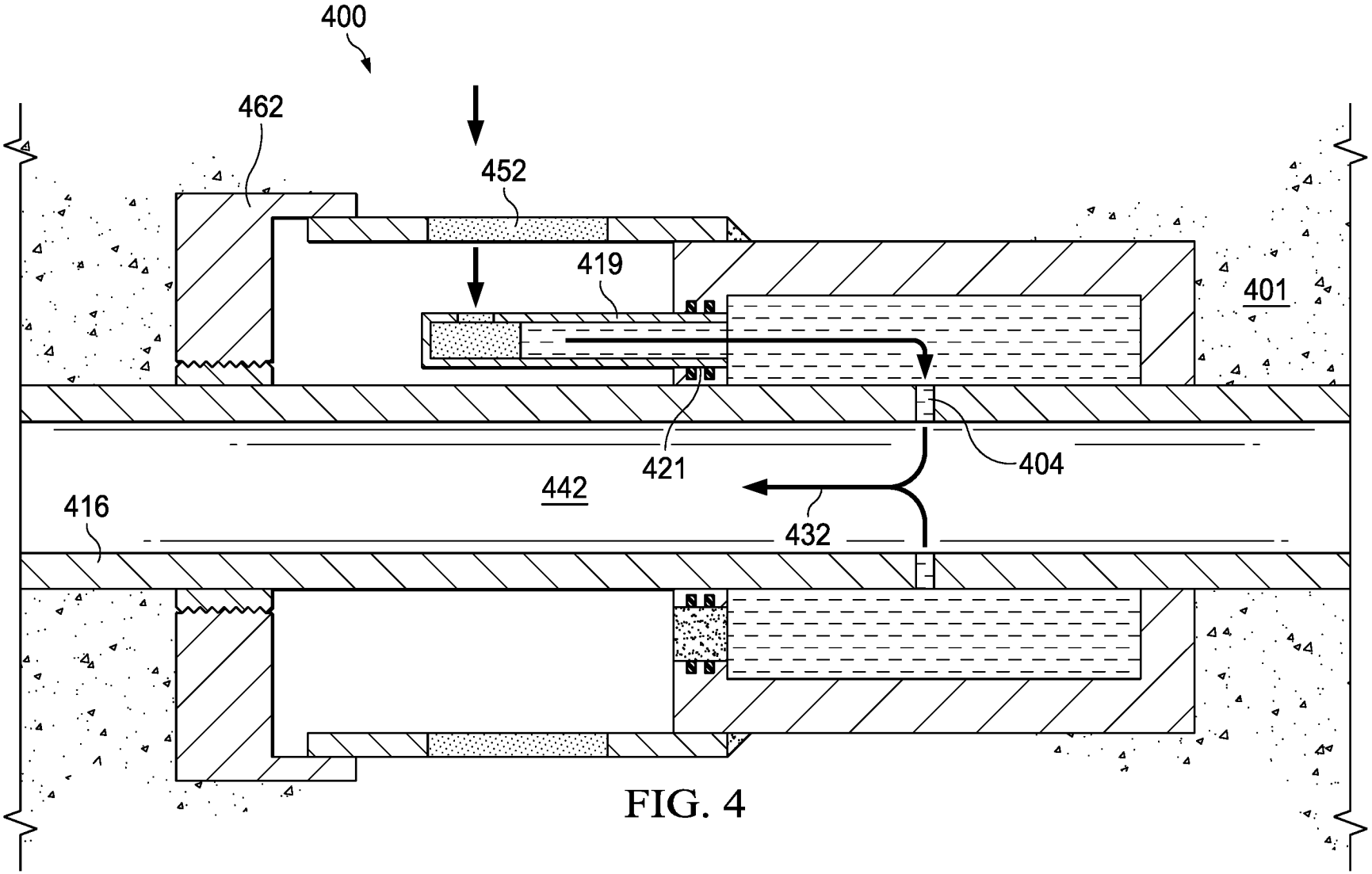
FIG. 4 illustrates a cross-sectional view of another dehydration assembly deployed in a wellbore with a gravel pack, and configured to dehydrate the gravel pack and to temporarily increase a flow rate of fluid flowing from the wellbore into a conveyance.

FIG. 4 illustrates a cross-sectional view of another dehydration assembly 400 deployed in a wellbore with a gravel pack 401, and configured to dehydrate gravel pack 401 and to temporarily increase a flow rate of fluid flowing from the wellbore into conveyance 416. In the illustrated embodiment of FIG. 4, dehydration assembly 400 is coupled to a section of conveyance 416. Dehydration assembly 400 has a cover 462 that can be easily screwed on or off to gain physical access to insertion port 421, and to insert valve 419 into insertion port 421. Examples of a cover include, but are not limited to, caps, end rings, and other removable or detachable components of a dehydration assembly. Valve 419 provides a fluid flow path in a direction indicated by arrow 432 from gravel pack 401 into an opening of valve 419, through valve 419 of dehydration assembly 400, and into an interior 442 of conveyance 416, where the fluid flows uphole. Further, a filter 452 is formed around valve 419 to filter particles greater than a threshold dimension. Dehydration assembly 400 also includes a first fluid port 404 that fluidly connects dehydration assembly 400 to conveyance 416. Additional descriptions of configurations of first fluid port 404 to modulate fluid flow into conveyance 416 are described herein. Although the foregoing paragraphs describe providing fluid flow into conveyance 416, in some embodiments, valve 419 provides a fluid flow path out of conveyance 416, and dehydration assembly 400 is deployed to temporarily provide fluid flow out of conveyance 416.

Figure 5:
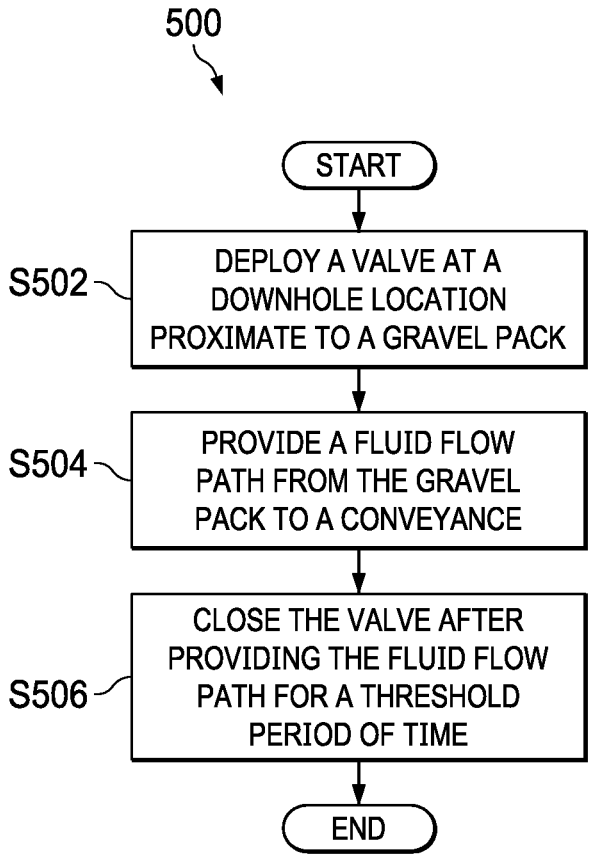
FIG. 5 illustrates a flowchart of a process to dehydrate gravel pack.

FIG. 5 is a flowchart of a process 500 to dehydrate gravel pack. Although the operations in process 500 are shown in a particular sequence, certain operations may be performed in different sequences or at the same time where feasible.

At block S502, a valve is deployed at a downhole location proximate to a gravel pack. FIG. 2 for example, illustrates deployment of dehydration assembly 200 having valve 219 near gravel pack 201. In some embodiments, valve 219 includes a rupture disk that ruptures in response to a threshold amount of pressure and reactive fluid that actuates the valve to a closed position. Additional or alternative combinations of components that form the valve are described herein. In some embodiments, the valve is deployed near other fluid flow paths to the conveyance. FIG. 3A for example, illustrates valve 319 deployed near perforations 340, which form fluid flow paths from gravel pack 301 into interior 342 of conveyance 316. In one or more of such embodiments, the valve is coupled to or formed over the perforations before the conveyance is deployed downhole to provide a fluid flow path from the gravel pack to the openings of the perforations, and to control the amount of time during which the fluid flows through the perforations into the conveyance. In some embodiments, the valve is deployed near one or more fluid restrictors that provide additional fluid flow paths from the gravel pack to the interior of the conveyance. In one or more of such embodiments, the valve provides a fluid flow path that bypasses the fluid restrictors while the valve is in an open position. In one or more of such embodiments, the valve is coupled to the fluid restrictors before the conveyance is deployed downhole to provide a fluid flow path from the gravel pack to the openings of the fluid restrictors, and to control the amount of time during which the fluid flows through the fluid restrictors into the interior of the conveyance. In some embodiments, a second valve is deployed near the gravel to provide a second fluid flow path from the gravel to the interior of conveyance. For example, where a valve is coupled to insertion port 223 of FIG. 2, the valve would provide a second fluid flow path from gravel pack 201 through the valve, and into interior 242 of second conveyance section 216B.

At block S504, the valve provides a fluid flow path from the gravel pack to the conveyance. As shown in FIG. 2, valve 219 is coupled to insertion port 221 to provide a fluid flow path in a direction indicated by arrow 230 from gravel pack 201 into an opening of valve 219, through valve 219 and dehydration assembly 200, and into an interior 242 of second conveyance section 216B, where the fluid flows uphole in a direction illustrated by arrow 232. In some embodiments, where multiple valves are deployed near the gravel pack, each valve provides a separate fluid flow path from the gravel pack into the interior of the conveyance. In one or more of such embodiments, some of the valves or fluid flow ports that fluidly connect some of the valves to the interior of the conveyance are initially closed to modulate flow fluid through the valves. In one or more of such embodiments, some of the valves or fluid flow ports that fluidly connect some of the valves to the interior of the conveyance are opened in a time sequence or a predetermined sequence to modulate fluid flow through the valves.

At block S506, the valve is closed after a threshold period of time (e.g., after 10 minutes, 20 minutes, 25 minutes, or after another period of time), thereby significantly reducing the fluid flow path. In some embodiments, the threshold period of time during which the valve is open is the amount of time from the deployment of the valve downhole until completion of a well operation, such as a gravel packing operation, a drilling operation, or another well operation. In some embodiments, the valve is closed after a threshold amount of fluid flows through the valve. In some embodiments, a filter is deployed around the valve to filter particles that are greater than a threshold dimension. FIG. 2 for example, illustrates filter 252 coupled to valve 219 to prevent particles greater than a threshold dimension from flowing into valve 219. In some embodiments, filter 252 is a screen. In one or more of such embodiments, the screen is wrapped around valve 219 or forms a housing around valve 219. FIG. 4 for example, illustrates filter 452 formed around valve 419 to filter particles greater than a threshold dimension. In some embodiments, where multiple valves are deployed near the gravel pack, different valves are closed at different times to modulate fluid flow into the interior of the conveyance. For example, where three valves are each configured to provide fluid flow into the interior of the conveyance at a rate of one gallon per hour (or another rate), one valve is configured to close after 20 minutes (or after another period of time) to reduce the flow rate to two gallons per hour, a second valve is configured to close after 50 minutes (or after another period of time) to further reduce the flow rate into the interior of the conveyance to one gallon per hour, and the third valve is configured to close after two hours (or another period of time) to prevent additional fluids and particles from flowing into the conveyance after two hours, or to reduce the flow rate of additional fluids into the conveyance to less than or equal to a threshold rate after two hours. In one or more of such embodiments, the flow rate through the valves, and the durations during which the valves are open are configurable to modulate fluid flow from the gravel pack into the conveyance.

Figure 6:
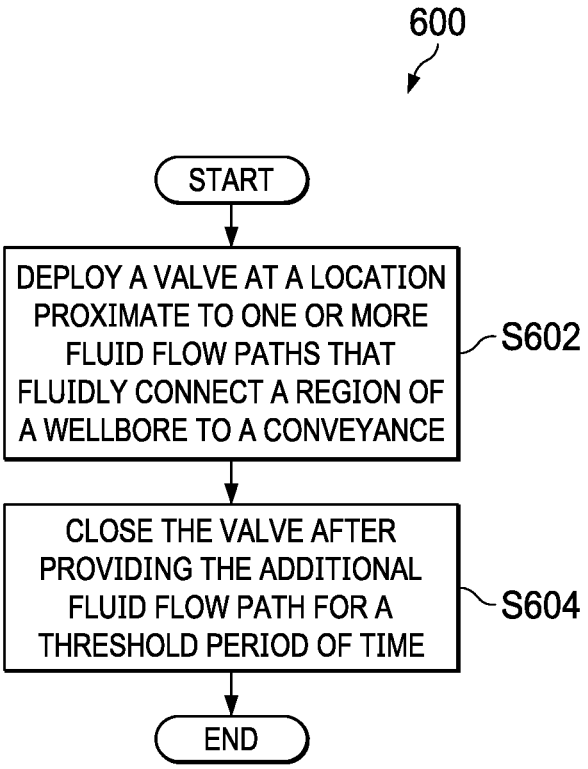
FIG. 6 illustrates a flowchart of a process to temporarily increase a flow rate of a fluid flowing from a wellbore into a conveyance.

FIG. 6 is a flowchart of a process 600 to temporarily increase a flow rate of a fluid flowing from a wellbore into a conveyance. Although the operations in process 600 are shown in a particular sequence, certain operations may be performed in different sequences or at the same time where feasible.

At block S602, a valve is deployed at a location proximate to one or more fluid flow paths that fluidly connect a region of a wellbore to a conveyance. FIG. 3A for example, illustrates valve 319 deployed near perforations 340 that provide fluid flow paths from the surrounding wellbore into interior 342 of conveyance 316. In the embodiment of FIG. 3A, valve 319 provides an additional fluid flow path in a direction indicated by arrow 330 from gravel pack 301 into an opening of valve 319, through valve 319 and dehydration assembly 300, and into interior 342 of conveyance 316, where the fluid flows uphole in a direction illustrated by arrow 332, thereby increasing the fluid flow rate of the fluid into conveyance 316. Although FIG. 3A illustrates conveyance 316 deployed during a gravel packing operation, valve 319 and conveyance 316 is deployable in other well operations to provide an additional fluid flow path through valve 319 while valve 319 remains open. In some embodiments, one or more additional valves are deployed near the valve to provide additional fluid flow paths from the wellbore to the interior of conveyance. At block S604, the valve is closed after providing the additional fluid flow path for a threshold period of time, thereby substantially reducing the fluid flow path through the valve. In some embodiments, the valve is closed after a threshold amount of fluid flows through the valve. In some embodiments, a filter is deployed around the valve to filter particles that are greater than a threshold dimension. In some embodiments, where multiple valves are deployed near the gravel pack, different valves are closed at different times to modulate fluid flow into the conveyance.

Figure 7A:
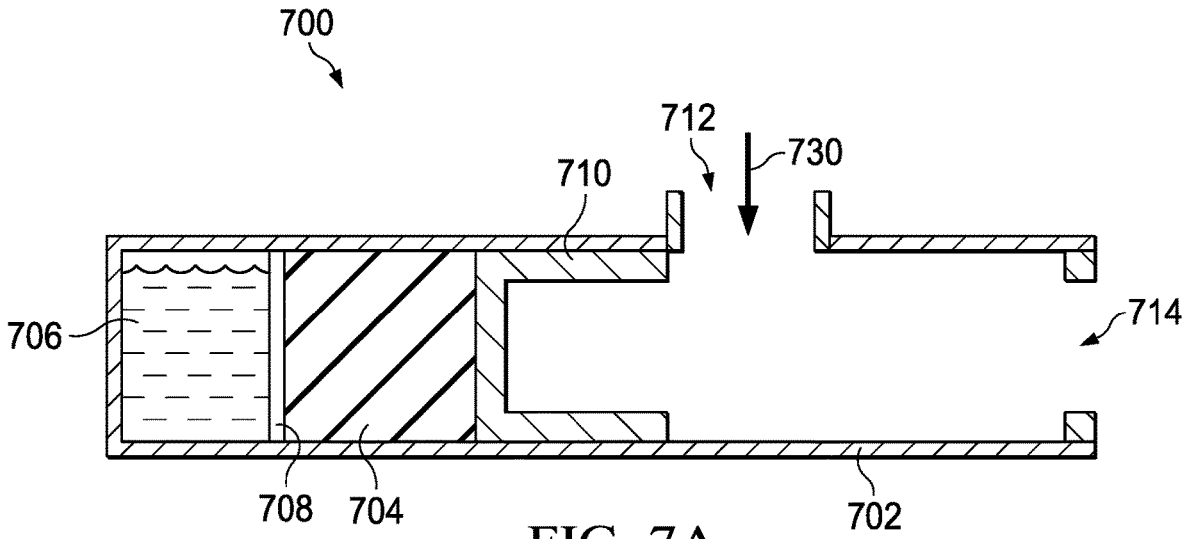
FIG. 7A illustrates a cross-sectional view of a valve while the valve is in an open position.
Figure 7B:
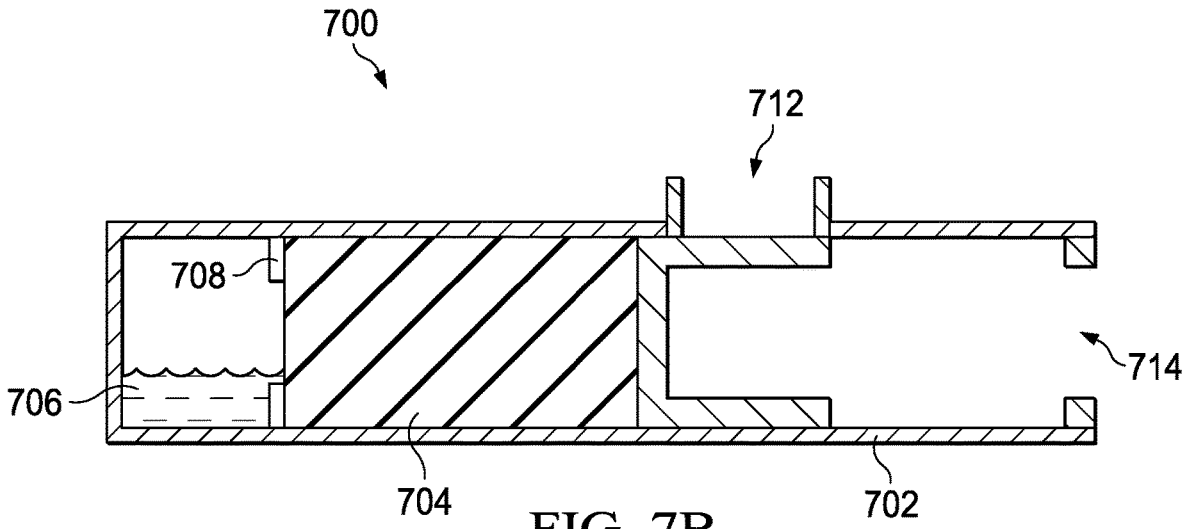
FIG. 7B illustrates a cross-sectional view of the valve of FIG. 7A while the valve is in a closed position.

FIG. 7A illustrates a cross-sectional view of a valve 700 while valve 700 is in an open position. Valve 700 includes a body (e.g., a tubular body) 702 containing a swellable elastomer 704. In the embodiment of FIGS. 7A-7B, swellable elastomer 704 swells in response to a reactive fluid, such as a reactive fluid 706, which is added into body 702 prior to valve being 700 deployed down a wellbore. In some embodiments, the reactive fluid contacts the swellable elastomer to cause the swellable elastomer to swell as the valve travels down the wellbore. Valve also a rupture disk 708 that are positioned between reactive fluid 706 and swellable elastomer 704. In the embodiment of FIGS. 7A and 7B, rupture disk 708 remains intact and prevents reactive fluid 706 from contacting swellable elastomer 704 until a predetermined condition (e.g., a predetermined time or a threshold amount of pressure) has been met. Once the predetermined condition has been met, rupture disk 708 partially or completely ruptures, thereby allowing reactive fluid 706 to contact swellable elastomer 704. For example, rupture disk 708 ruptures once the reactive fluid has reached a certain pressure. Additionally or alternatively, rupture disk 708 ruptures in response to hydrostatic pressure in the wellbore, pressure in the wellbore above bottom-hole pressure, or increased temperature in the wellbore. Valve 700 also includes a piston component (piston) 710. In the embodiment of FIGS. 7A and 7B, swellable elastomer 704 swells and contacts piston 710 to move the piston from a first position (e.g., an open state) as shown in FIG. 7A to a second position (e.g., a closed state) as shown in FIG. 7B. In the embodiment of FIG. 7A, valve 700 initially provides a fluid flow path to allow well fluid to travel into an inlet opening 712 of valve 700, such as in direction of arrow 730, through body 702 of 700 valve to an outlet opening 714 of valve 700.

FIG. 7B illustrates a cross-sectional view of valve 700 of FIG. 7A while valve 700 is in a closed position. In the embodiment of FIG. 7B, rupture disk 708 is no longer intact to prevent reactive fluid 706 from contacting swellable elastomer 704. Further, swellable elastomer 704 swells in response to contact with reactive fluid 706. The swelling of swellable elastomer 704 moves piston 710 from the first position as shown in FIG. 7A to the second position as shown in FIG. 7B. Moreover, piston 710 is moved to the second position that covers inlet opening 712, thereby restricting well fluid from travel into inlet opening 712, such as in direction of arrow 730 of FIG. 7A, and through body 702 to outlet opening 714.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, although the flowcharts depict a serial process, some of the steps/processes may be performed in parallel or out of sequence, or combined into a single step/process. The scope of the claims is intended to broadly cover the disclosed embodiments and any such modification. Further, the following clauses represent additional embodiments of the disclosure and should be considered within the scope of the disclosure.

Clause 1, a method to dehydrate a gravel pack, the method comprising: deploying a valve at a downhole location proximate to a gravel pack, the valve comprising a rupture disk that ruptures in response to a threshold amount of pressure; and reactive fluid that actuates the valve to a closed position; providing a fluid flow path from the gravel pack to a conveyance; and closing the valve after providing the fluid flow path from the gravel pack to the conveyance for a threshold period of time.

Clause 2, the method of clause 1, further comprising closing the valve after a threshold amount of fluid flows through the fluid flow path.

Clause 3, the method of clauses 1 or 2, further comprising deploying a filter around the valve to filter solid particles having dimensions greater than a threshold dimension.

Clause 4, the method of clause 3, wherein the filter is a screen.

Clause 5, the method of clauses 3 or 4, wherein deploying the filter comprises forming, with the filter, a housing around the valve.

Clause 6, the method of any of clauses 1-5, wherein deploying the valve comprises deploying the valve proximate to one or more perforations through the conveyance, wherein the one or more perforations provide one or more additional fluid flow paths from the gravel pack to the conveyance.

Clause 7, the method of clause 6, wherein deploying the valve comprises deploying the valve over the one or more perforations before the conveyance is deployed downhole.

Clause 8, the method of clause 6 or 7, wherein the one or more additional fluid flow paths flow through a restrictor, and wherein the fluid flow path bypasses the restrictor while the valve is in the open position.

Clause 9, the method of any of clauses 1-8, further comprising deploying a second valve at a second location proximate to the gravel pack; providing a second fluid flow path from the gravel pack to the conveyance; and closing the second valve after providing the second fluid flow path for a second threshold period of time.

Clause 10, the method of clause 9, wherein the valve and the second valve are simultaneously deployed to provide fluid flow paths from the gravel pack to the conveyance.

Clause 11, the method of clauses 9 or 10, wherein closing the second valve comprises closing the second valve after the valve is closed.

Clause 12, a method to temporarily increase a flow rate of fluid flowing from a wellbore into a conveyance, the method comprising: deploying a valve at a location proximate to one or more fluid flow paths that fluidly connect a region of a wellbore to a conveyance, the valve initially providing an additional fluid flow path from the region of the wellbore to the conveyance, the valve comprising: a rupture disk that ruptures in response to a threshold amount of pressure; and reactive fluid that actuates the valve to a close position; and closing the valve after providing the additional fluid flow path from the region of the wellbore to the conveyance for a threshold period of time.

Clause 13, the method of clause 12, further comprising closing the valve after a threshold amount of fluid flows through the additional fluid flow path.

Clause 14, the method of clauses 12 or 13, further comprising deploying a filter around the valve to filter solid particles having dimensions greater than a threshold dimension.

Clause 15, the method of clause 14, wherein deploying the filter comprises forming, with the filter, a housing around the valve.

Clause 16, the method of any of clauses 12-15, wherein the one or more fluid flow paths are formed by one or more perforations, and wherein deploying the valve at the location proximate to the one or more fluid flow paths comprises deploying the valve near the one or more perforations.

Clause 17, the method of clause 16, wherein deploying the valve comprises deploying the valve over the one or more perforations before the conveyance is deployed downhole.

Clause 18, the method of any of clauses 12-17, wherein the one or more fluid flow paths flow through a restrictor, and wherein the additional fluid flow path bypasses the restrictor while the valve is in the open position.

Clause 19, the method of any of clauses 12-18, further comprising deploying a second valve at a second location proximate to the one or more fluid flow paths that fluidly connect the region of the wellbore to a conveyance, wherein the second valve initially provides a second fluid flow path from the region of the wellbore to the conveyance; and closing the second valve after providing the second fluid flow path for a second threshold period of time.

Clause 20, the method of clause 19, wherein the valve and the second valve are simultaneously deployed to provide additional fluid flow path and the second fluid flow path from the region of the wellbore to the conveyance, and wherein the second valve is closed after the first valve is closed.

Unless otherwise specified, any use of any form of the terms "connect," "engage," "couple," "attach," or any other term describing an interaction between elements in the foregoing disclosure is not meant to limit the interaction to direct interaction between the elements and may also include indirect interaction between the elements described. As used herein, the singular forms "a", "an," and "the" are intended to include the plural forms as well, unless the context clearly indicates otherwise. Unless otherwise indicated, as used throughout this document, "or" does not require mutual exclusivity. It will be further understood that the terms "comprise" and/or "comprising," when used in this specification and/or in the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

It should be apparent from the foregoing that embodiments of an invention having significant advantages have been provided. While the embodiments are shown in only a few forms, the embodiments are not limited but are susceptible to various changes and modifications without departing from the spirit thereof.

What we claim:

1. A method to dehydrate a gravel pack, the method comprising:

deploying a valve at a downhole location proximate to a gravel pack, the valve comprising:

a rupture disk that ruptures in response to a threshold amount of pressure;

reactive fluid; and a swellable elastomer;

rupturing the rupture disk, wherein the reactive fluid comes into contact with the swellable elastomer after the rupture disk is ruptured;

providing a fluid flow path from the gravel pack to a conveyance; and after providing the fluid flow path from the gravel pack to the conveyance for a threshold period of time, shifting a piston of the valve from a first position to a second position to close the valve, wherein the piston is shifted from the first position to the second position by an expansion of the swellable elastomer.

2. The method of claim 1, further comprising closing the valve after a threshold amount of fluid flows through the fluid flow path.

3. The method of claim 1, further comprising deploying a filter around the valve to filter solid particles having dimensions greater than a threshold dimension.

4. The method of claim 3, wherein the filter is a screen.

5. The method of claim 3, wherein deploying the filter comprises forming, with the filter, a housing around the valve.

6. The method of claim 1, wherein deploying the valve comprises deploying the valve proximate to one or more perforations through the conveyance, wherein the one or more perforations provide one or more additional fluid flow paths from the gravel pack to the conveyance.

7. The method of claim 6, wherein deploying the valve comprises deploying the valve over the one or more perforations before the conveyance is deployed downhole.

8. The method of claim 6, wherein the one or more additional fluid flow paths flow through a restrictor, and wherein the fluid flow path bypasses the restrictor while the valve is in the open position.

9. The method of claim 1, further comprising deploying a second valve at a second location proximate to the gravel pack;

providing a second fluid flow path from the gravel pack to the conveyance; and closing the second valve after providing the second fluid flow path for a second threshold period of time.

10. The method of claim 9, wherein the valve and the second valve are simultaneously deployed to provide fluid flow paths from the gravel pack to the conveyance.

11. The method of claim 9, wherein closing the second valve comprises closing the second valve after the valve is closed.

12. A method to temporarily increase a flow rate of fluid flowing from a wellbore into a conveyance, the method comprising:

deploying a valve at a location proximate to one or more fluid flow paths that fluidly connect a region of the wellbore to the conveyance, the valve initially providing an additional fluid flow path from the region of the wellbore to the conveyance, the valve comprising:

a rupture disk that ruptures in response to a threshold amount of pressure;

reactive fluid; and a swellable elastomer;

rupturing the rupture disk, wherein the reactive fluid comes into contact with the swellable elastomer after the rupture disk is ruptured; and after providing the additional fluid flow path from the region of the wellbore to the conveyance for a threshold period of time, shifting a piston of the valve from a first position to a second position to close the valve, wherein the piston is shifted from the first position to the second position by an expansion of the swellable elastomer.

13. The method of claim 12, further comprising closing the valve after a threshold amount of fluid flows through the additional fluid flow path.

14. The method of claim 12, further comprising deploying a filter around the valve to filter solid particles having dimensions greater than a threshold dimension.

15. The method of claim 14, wherein deploying the filter comprises forming, with the filter, a housing around the valve.

16. The method of claim 12, wherein the one or more fluid flow paths are formed by one or more perforations, and wherein deploying the valve at the location proximate to the one or more fluid flow paths comprises deploying the valve near the one or more perforations.

17. The method of claim 16, wherein deploying the valve comprises deploying the valve over the one or more perforations before the conveyance is deployed downhole.

18. The method of claim 12, wherein the one or more fluid flow paths flow through a restrictor, and wherein the additional fluid flow path bypasses the restrictor while the valve is in the open position.

19. The method of claim 12, further comprising:

deploying a second valve at a second location proximate to the one or more fluid flow paths that fluidly connect the region of the wellbore to a conveyance, wherein the second valve initially provides a second fluid flow path from the region of the wellbore to the conveyance; and closing the second valve after providing the second fluid flow path for a second threshold period of time.

20. The method of claim 19, wherein the valve and the second valve are simultaneously deployed to provide additional fluid flow path and the second fluid flow path from the region of the wellbore to the conveyance, and wherein the second valve is closed after the first valve is closed.

* * * * *